United States Patent [19]

Batchelor

[11] 4,218,967

[45] Aug. 26, 1980

[54] VACUUM PUMP CLOSURE FOR CANISTERS AND VACUUM PACK CONTAINERS

[76] Inventor: John H. Batchelor, 1658 Lomacita Ter., El Cajon, Calif. 92021

[21] Appl. No.: 51,366

[22] Filed: Jun. 25, 1979

Related U.S. Application Data

[63] Continuation-in-part of Ser. No. 963,691, Nov. 27, 1978, abandoned.

[51] Int. Cl.[2] ..... B65D 57/16; A23B 0/00

[52] U.S. Cl. ..... 99/472; 220/231; 206/524.8

[58] Field of Search ..... 220/231, 256, 234; 206/524.8; 99/472

[56] References Cited

U.S. PATENT DOCUMENTS

| | | | |
|---|---|---|---|
| 1,946,872 | 2/1934 | Muhleisen | 99/472 |
| 2,669,176 | 2/1954 | Lazerus | 99/472 |
| 2,890,810 | 6/1959 | Rohling | 220/231 |
| 4,083,468 | 4/1978 | Batchelor | 220/234 |

*Primary Examiner*—George T. Hall
*Attorney, Agent, or Firm*—William H. Maxwell

[57] ABSTRACT

A closure device for canisters and a reclosure for vacuum pack containers and comprised of a removeable diaphragm that seals with the opened end of the container and a cover overlying the diaphragm to form a pump chamber therebetween, there being actuating means to axially reciprocate the diaphragm relative to the cover, and check valves in the diaphragm and cover for drawing a high vacuum upon the contents within the said container, and with means to release said vacuum.

30 Claims, 14 Drawing Figures

VACUUM PUMP CLOSURE FOR CANISTERS AND VACUUM PACK CONTAINERS

This is a continuation-in-part of application Ser. No. 963,691 filed Nov. 27, 1978 now abandoned.

BACKGROUND

Food stuffs such as coffee, nuts, fruits and jams etc. are vacuum packed in order to maintain freshness for delivery to the consumer. Obviously however, the products begin to loose freshness the moment the container is opened and the vacuum lost to the surrounding atmosphere which is normally humid to a substantial degree. Therefore, hermetic closures have been attempted but even then the capture of air at atmospheric pressure subjects the product to the permeation of dampness. On the contrary, the reestablishment of a partial vacuum would impose the depressurization known to be so beneficial in maintaining freshness, and to this end it is a general object of this invention to provide a closure that draws a vacuum upon a container to preserve the freshness of the product previously vacuum packed therein. Reference is made to my previous U.S. Pat. No. 4,083,468 entitled "VACUUMIZING CLOSURE FOR VACUUM PACK CONTAINERS" issued Apr. 11, 1978, involving a vacuumizing closure that substantially reduces atmospheric pressure within the container so as to draw moisture from the product stored therein, thereby eliminating the otherwise expected gradual but continuous permeation of moisture leading to staleness of the product.

The application to containers of the usual stoppers, plug-in and screw-in closures, tends to compress the interior rather than to depress the same, and thereby impresses the atmospheric humidity upon the product remaining therein. The greater the volume of remaining product the greater is the compressive and/or depressive effect, due to the smaller remaining container space to be filled by said atmosphere. However, the lesser the volume of remaining product the greater is the remaining container space inherently filled with atmospheric humidity to have its adverse effect upon the product. Therefore, as the product is depleted the remaining air space becomes proportionately greater and presents an increasing volume of air subject to removal. Accordingly, it is an object of this invention to provide an improved closure that initially occupies the chamber together with the product therein, and operable to pump atmospheric humidity therefrom.

Containers for food stuffs are not filled to their brim, but are filled to a level which constitutes a measured portion either by weight or by volume. In any case, the fill level is below the container rim, and it is from this level that a portion of the product will be taken at the first opening of said container. For example, when brewing coffee the product level will be approximately an inch below the container rim after withdrawing sufficient coffee to brew a large pot thereof; and it is this measurement which determines the depth to which the present closure penetrates and which determines the permissible depth and draw of the diaphragm. It is an object therefore, to maximize the closure occupancy to thereby maximize the depth and draw of the diaphragm. With this invention, the closure enters into the container to the level of product therein, preferably after a normal portion thereof has been removed, thereby maximizing the vacuum pump effect.

The resealing of containers such as metal cans is a problem once the hermetic seal of the integral lid is broken, as for example by complete removal of said lid. With the usual beaded can construction, the rolled and/or crimped bead of the can is left to present a circumferential rim of smooth uniform cross section, distorted to some extent perhaps by slight imperfection in manufacture and by bending during the can opening process. Accordingly, it is an object of this invention to reestablish a hermetic seal with the bead left remaining at the circumferential rim of the can, to seal with the inner and outer diameters of the bead.

The amount of partial vacuum drawn by this device is dependent upon the number of strokes applied to the diaphragm. Whereas my previously patented closure is limited to a single stroke, the present device is adapted to operate as a multi stroke pump, and to this end check valve means are provided at both the diaphragm and at the cover so as to establish a variable volume pump chamber therebetween. It is an object therefore to reciprocate the diaphragm relative to the cover that establishes the pump chamber, and in practice three to six strokes will draw a most effective and high vacuum as circumstances require. Further, it is now necessary to release said vacuum and to this end it is another object to provide a bleed means through the diaphragm and cover or into the canister as desired.

The type and shape of the container to be sealed and vacuumized can vary widely, and it is therefore an object of this invention to accommodate glass or ceramic jars as well as tins, and including all cross sections thereof such as square, rectangular, oval or any other shape than cylindrical. Accordingly, it is an object of this invention to provide a vacuum pump closure for at least two shapes of container, namely a cylindrical container and one that is other than cylindrical. Primarily, it is the perimeter seal which is to be established and maintained and to this end it is an object to provide one or more perimeter seals engageable with the rim or bead of the container, jar or can, and which draws more tightly into sealed engagement therewith as the vacuum is increased.

It is a general object of this invention to provide a Vacuumizing Pump Closure of the character hereinabove referred to that is simple and economical of manufacture, and a device that is inherently practical for the purpose intended of pumping a partial vacuum upon the remaining content of a canister or jar or can and any such vessel that has been opened and/or which requires closure, so as to establish a hermetic seal with the rim or bead at the otherwise opened end thereof, a feature of the invention being the simplicity of application which requires movement of an actuating lever, and removal which requires opening of a bleed valve.

SUMMARY OF INVENTION:

This invention relates particularly to the vacuumizing of jars and canisters in which edibles or food stuffs are to be kept fresh, and also to beaded metal cans as disclosed in my previous U.S. Pat. No. 4,083,468. To this end I provide a cover A that carries an axially extended diaphragm B, and an actuator means C that reciprocates the diaphragm between extended and withdrawn positions thereby establishing a variable volume pump chamber therebetween. A feature of this invention is the provision of primary and secondary check valves V1 and V2 in the diaphragm and cover respectively, and a relief valve V3, V4 or V5 for breaking the vacuum.

There is hermetic engagement of the diaphragm B with the bead of the container, by means of a seal S that tightly embraces the perimeter bead thereof, while pumping operation is by actuator means C that reciprocates the diaphragm B relative to the cover A, thereby increasingly drawing a partial vacuum within the container while pulling the seal S1 tightly into engagement with the rim or bead thereof. The device is removable through operation of the relief valve V3, V4 or V5 which breaks the vacuum and thereby frees the diaphragm seal S1, or S2.

DRAWINGS

The various objects and features of this invention will be fully understood from the following detailed description of the typical preferred form and application thereof, throughout which description reference is made to the accompanying drawings, in which.

Figure 6:
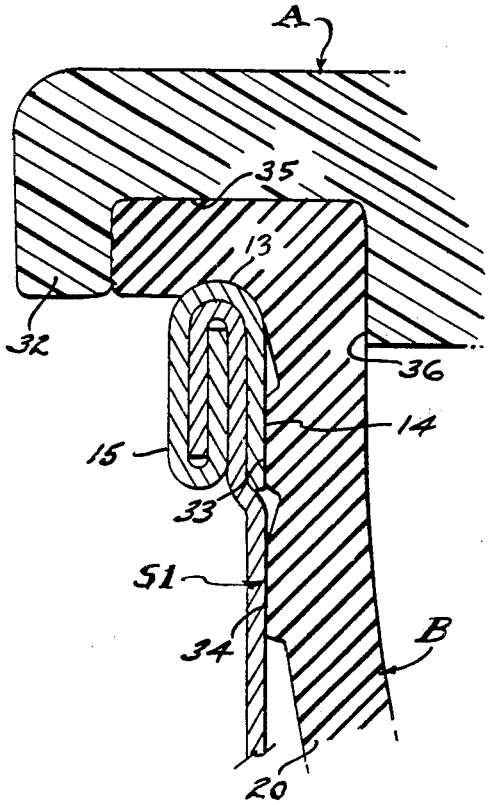

FIG. 6 to the bead of a tin can.

Figure 3:
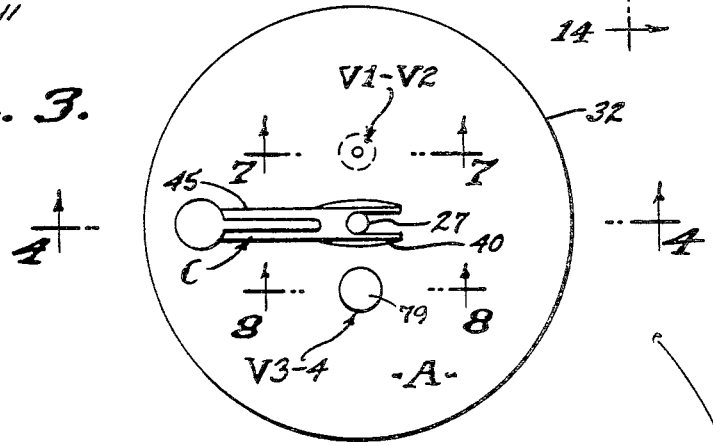
FIG 3 is a plan view taken as indicated by line 3—3 on FIG. 1.
Figure 7:
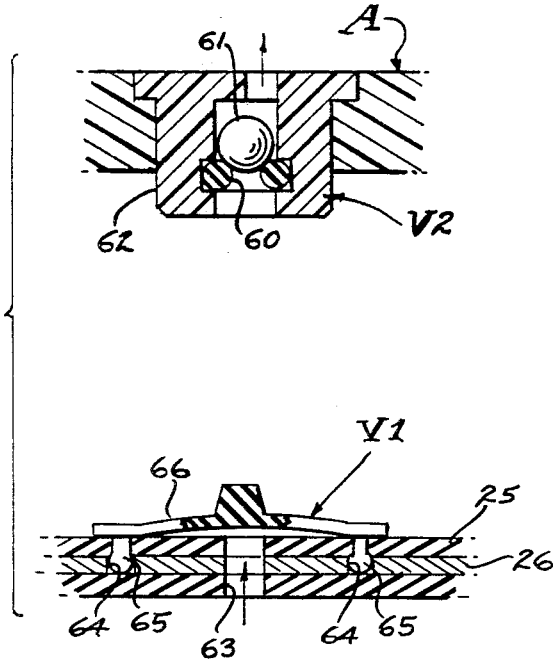

FIG. 7 is an enlarged detailed sectional view of the check valves V1 and V2 and taken as indicated by line 7—7 on FIG. 3.

Figure 8:
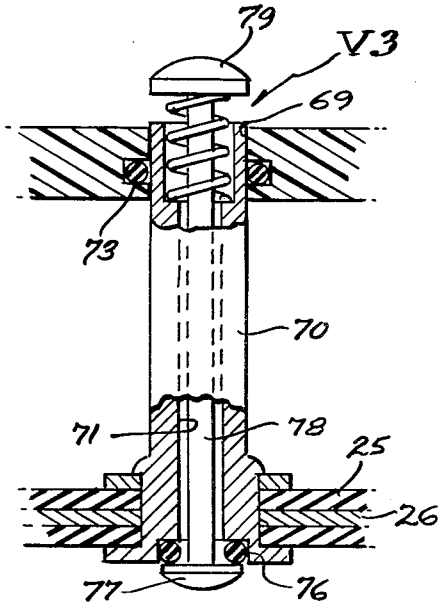

FIG. 8 is an enlarged detailed sectional view of the bleed valve V3 and taken as indicated by line 8—8 on FIG. 3.

Figure 9:
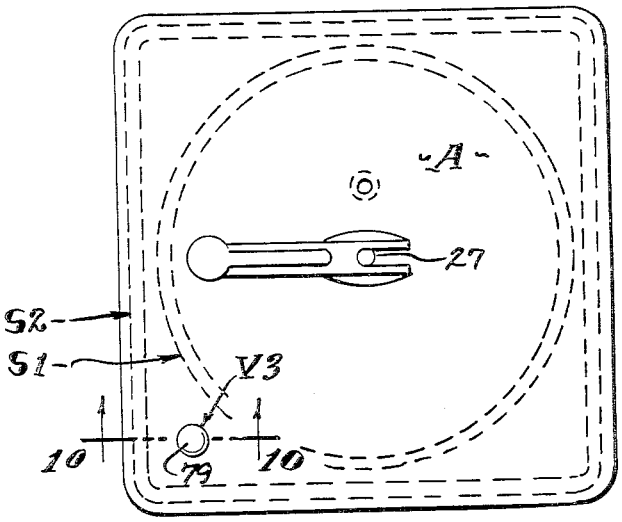

FIG. 9 is a view similar to FIG. 3, showing the vacuum pump closure adapted to a polygonal container cross section.

Figure 10:
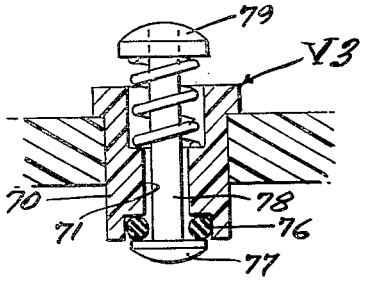

FIG. 10 is an enlarged detailed sectional view of the bleed valve V3 taken as indicated by line 10—10 on FIG. 9.

Figure 5:
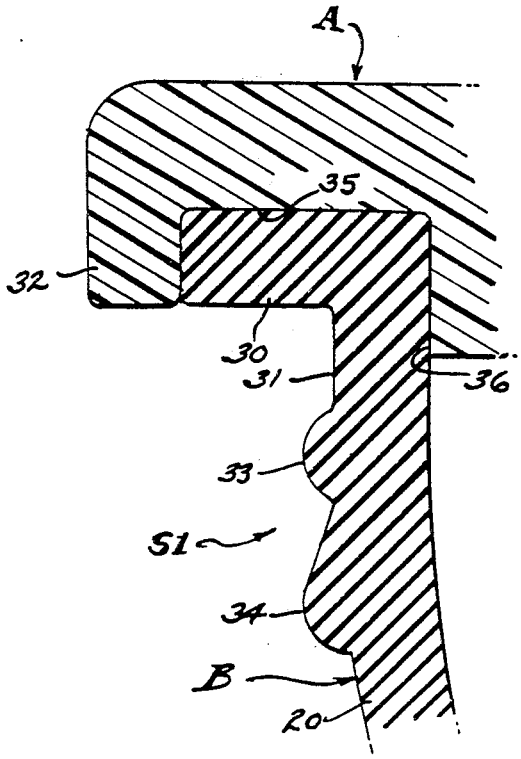
FIG. 5 is an enlarged detailed fragmentary view showing the seal.
Figure 11:
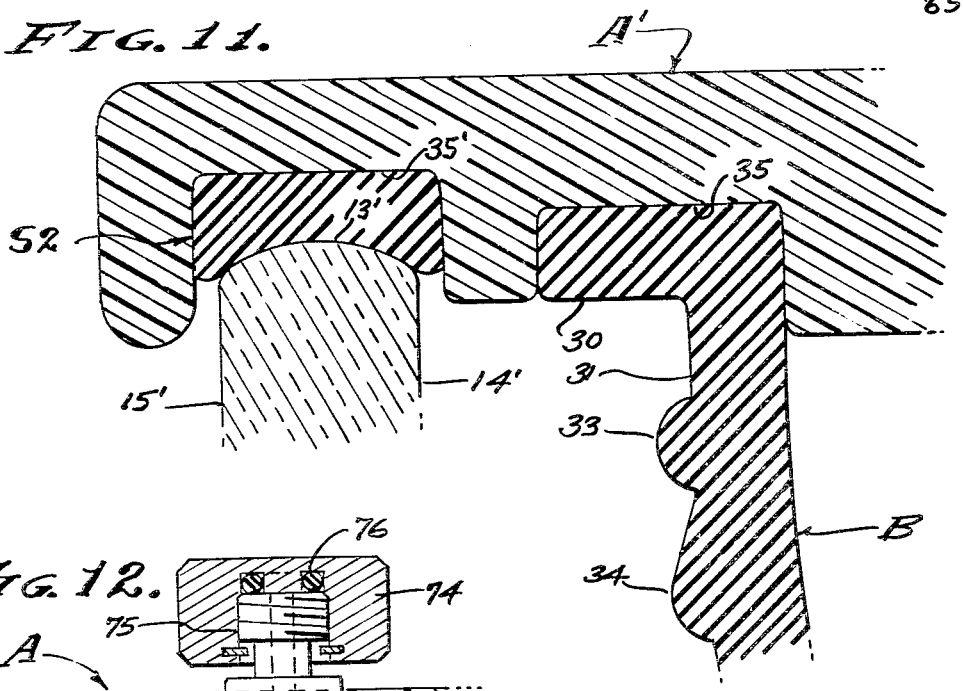

FIG. 11 is a view similar to FIGS. 5 or 6, showing the FIG. 9 application to the rim of a glass jar.

Figure 12:
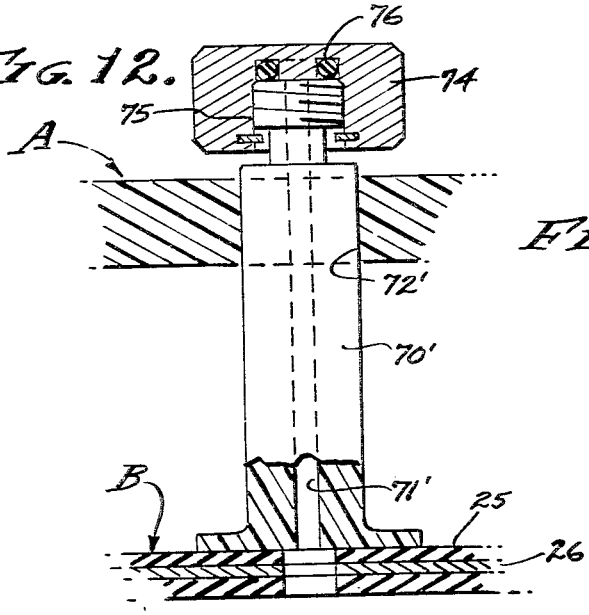

FIG. 12 is an enlarged detailed sectional view similar to FIG. 8, showing the bleed valve V4 modification.

Figure 13:
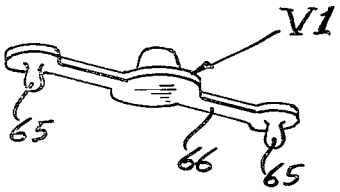

FIG. 13 is a perspective view of the strap valve V3 removed from FIG. 7, and

Figure 2:
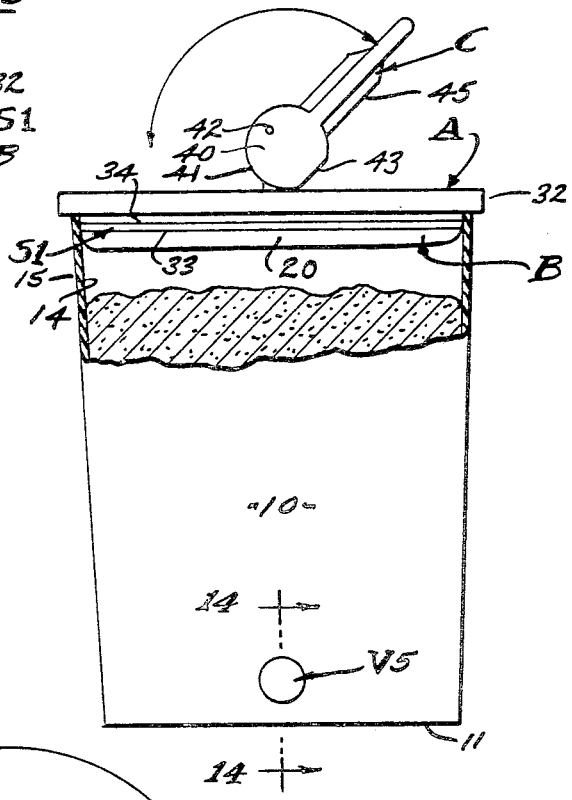
FIG. 2 is a view similar to FIG. 1 with the vacuumizing closure applied and a portion or the canister being broken away to show the content and closure relationship while being pumped.
Figure 14:
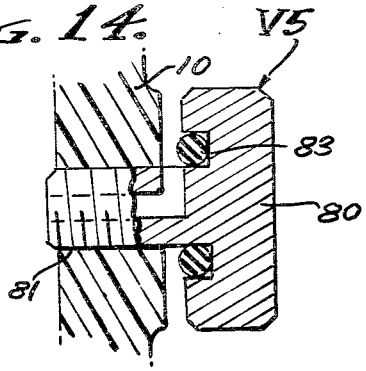

FIG. 14 is an enlarged detailed sectional view of the bleed valve V5 and taken as indicated by line 14—14 on FIG. 2.

PREFERRED EMBODIMENT

This invention is primarily concerned with a container comprised of a perimeter body wall 10, a bottom 11 and a rim or bead 13. Reference is made to the rims of jars and to the beads of the so-called "tin can" comprised of a cylindrical body and opposite disc-shaped ends secured to the body by rolled or crimped beads. It is to be understood that any type or style of container can be closed provided it has a planar rim or bead to receive the vacuum seal herein disclosed. Access or entry into such a jar or tin can is by means of removing one of said ends, leaving an open perimeter defined by the rim or bead from which the end cover lid or disc has been removed. Although this is the present standard, the disclosure herein is also concerned with plastic canisters, and all of which present inner and outer diameter walls 14 and 15 joined by the rim 13 disposed in a plane normal to the canister axis. In practice, the upper surface of the rim 13 is convex in cross section and of substantial thickness, of molded cross section in glass jars and the like, and in tin cans developed from a continuous circumferential flange of material folded outwardly and downwardly and then inwardly so as to lock the end closure to the can body. A feature is the uninterrupted coplanar nature of the said rim 13 that forms the open upper periphery of the container.

Referring now to the Vacuumizing Pump Closure of the present invention, the cover A is a rigid member that carries the flexible diaphragm B and the actuator means C therefor, the seal S1 being incorporated in the periphery of the said diaphragm. The valves V1, V2 and V3 are incorporated in and/or carried by the diaphragm and cover, as will be described. Structurally, the cover A and parts of the means C are made of rigid polystyrene plastic or the like, while the diaphragm B with its seal S is made of a more supple material such as an elastomer or rubber or plastic such as polypropylene or preferably Kraton as manufactured by Shell. As shown, parts of the actuator means and valves can be made of metal or plastic as may be desired.

The diaphragm B is comprised of an axially extended peripheral bellows 20 depending from the seal S1 to a piston wall 25 occupying the greater central area of the container interior. For example, the piston wall 25 is approximately or more than three quarters the area of the diaphragm B. In carrying out this invention, the diaphragm B and seal S1 are integrally formed of said rubber-like elastomeric material, rubber or plastic, to extend from the seal S1 and throughout the bellows 20 and piston wall 25 so as to present a member having flexibility that permits axial shifting of said piston wall 25. The properties of said elastomer, rubber or plastic material provides for flexibility required of the seal and bellows respectively, and the piston wall 25 is made rigid by a piston plate 26 as part of the actuator means C. The bellows 20 curves downwardly and inwardly from the seal S1 and terminates at the periphery of a disc-shaped piston 25 that encapsulates the piston plate 26. In carrying out the invention, the piston 25 is injection molded around the plate 26 and a pison rod 27 projecting therefrom.

Referring now to the seal S1, the perimeter of the diaphragm B is characterized by a downwardly faced flange that engages over the rim 13 of the container. The said flange is annular and comprised of a flat planar wall 30 normal to the central axis and an outer diameter wall 31 spaced inward from a peripheral rib 32 to enter within the rim 13 of enlarged containers (see FIG. 11) and to have a pressured fit with the inner diameter wall 14 of a fitting container (see FIG. 6). The walls 30 and 31 are of substantial thickness, the diameter of wall 31 such that the fitting container rim is a sliding interference fit therewith while compressing the elastomer material of the seal S1. Projecting from the outer diameter wall 31 there is a sealing lip 33, protruding radially to interfere with the inner diameter wall 14. Further, there is a similar sealing lip 34 spaced downwardly from lip 33, both lips being continuously engageable around the inside diameter wall of the container body immediately below the rim 13 thereof.

The seal lips 33 and 34 are restrained by the cover A, as will be described, to bear outwardly into pressured engagement with said inner diameter wall of the fitting container. In their preferred form, the seal lips are ribs or protrusions of semi-circular cross section establishing the outer peripheral equivalent of an O-ring seal biased into tight interference engagement with the canister wall so that differential pressure caused by a partial vacuum within the container is effectively checked. It will be apparent how the seal channel and lips 33 and 34 jamb into the upper open end of the canister for tight hermetic engagement.

Figure 1:
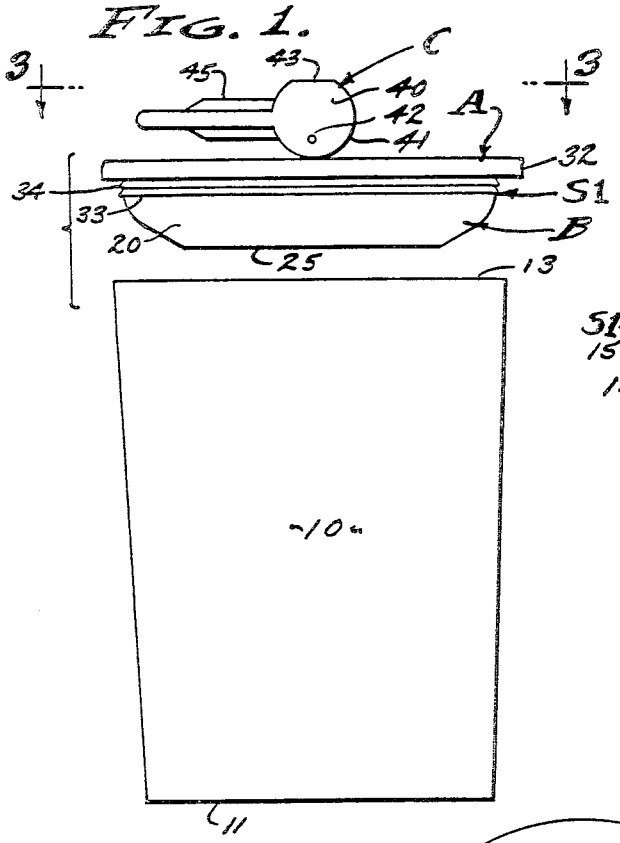
FIG. 1 is an exploded side elevation of a canister with the vacuumizing closure separated therefrom.
Figure 4:
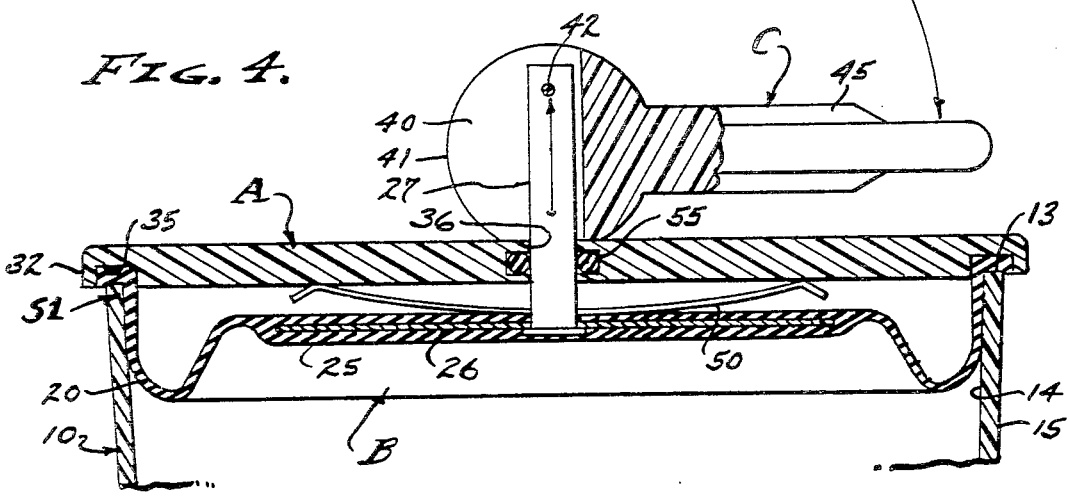
FIG. 4 is an enlarged detailed sectional view, similar to the upper portion of FIGS. 1 and 2, showing the set relationship after vacuumizing.

Referring now to the diaphragm B, the bellows 20 thereof is a flexible membrane of a thickness thereby sufficiently pliable or bendable and with a memory to reciprocate between the extended position shown in FIG. 1 to the retracted position shown in FIG. 4. Assurance of said movement is by means of a spring 50, preferably a leaf spring that readily flattens when compressed between the upper piston plate and bottom side of cover A. The piston wall 25 thereof is stiffened by the piston plate 26 and with a piston rod 27 projecting axially upward therefrom and through the cover A. The fit of piston rod 27 through the cover A is close and/or sealed with a gland 55 to stop leakage. The bellows 20 is of concavo-convex form extending axially downward from the perimeter seal S1 and inwardly at an obtuse angle with respect to the plane of the piston wall and plate 25–26. Accordingly, the said piston wall and plate are initially offset a substantial distance downward from the plane of the open container end defined by its rim 13, for example 1/5 diameter of the cover A.

The cover A comprises a plate with the perimeter thereof coextensively overlying the seal S1, carried by means of a downwardly open channel or recess 35 that locates and backs up the seal lips 33 and 34 and which applies downward pressure to the flange wall 30 when the actuator means C is operated. The center portion of the cover A is characterized by a depending boss-like wall 36 of the recess, to back up the seal S1. In FIGS. 1–6 the canister is cylindrical, in which case the perimeter of the cover A is characterized by a round configuration overlying the seal S1 in the form of the channel or recess 35 to accommodate the same. In FIGS. 9 and 10 the cover A configuration is other than round and for purpose of example is squared to overlie a glass jar (see FIG. 11) container of corresponding configuration. In accordance with this invention, the perimeter of cover A is extended laterally to overlie a seal S2 and carrying it in opposition to the rim 13' of the jar (as shown). The seal S2 is a continuous circumferential member of elastomer, rubber or plastic such as polypropylene or preferably Kraton as manufactured by Shell, in sheet or ring form carried in a downwardly open channel or recess 35' that locates or backs up the seal for the application of downward pressure thereto upon the rim 13' of the jar or like container.

The walls 30 and 31 comprise the annular body of the seal S1 that is restrictively accommodated in and preferably cemented in the channel or recess 35, to be backed up both radially and axially. The axial back-up is for the downward application of pressure to the seal, while the radial back-up is for the outward bias of the lips 33 and 34 thereof. Centrally of the cover A there is an opening 36 having a groove to accommodate the gland 55, an O-ring to pass the piston rod 27, thereby establishing a closed pump chamber within the diaphragm-cover combination.

Referring now to the actuator means C, the piston wall 25 is positioned by its connection with the piston plate 26 to assume the alternate positions shown in FIGS. 1 and 4. The memory of the diaphragm B establishes the initial extended position of FIG. 1, assured by spring 50, while withdrawal as by means of a pull rod or "T" handle (not shown) establishes the set position of FIG. 4. Preferably, there is a lift cam 40 revolved by a manually operable lever 45. In carrying out this invention, a high lift cam is employed that operates through an arc of 180° to reciprocate the piston plate 26 between the extended position to the retracted position. To this end the cam comprises a semi-circular face 41 slideably engageable with the flat top of the cover A and pivoted eccentrically by a pin 42 on a transverse axis to the rod 27. Diametrically opposite the eccentric offset of pin 42 there is a flat 43 that has releasably positioned engagement with the top of the cover. The lever 45 is integral with the cam 40 and extends in alternately radial directions between opposite perimeters of the cover A between which it is manually swung or shifted for its operation in alternately reciprocating the rod 27 to extend or retract the diaphragm B as shown.

In accordance with this invention there are primary and secondary valves V1 and V2 installed in the diaphragm B and cover A respectively (see FIG. 7). These two valves are check valves and both are faced so as to permit upward flow of air and to prevent downward flow thereof, through the chamber of variable volume within the confines of the diaphragm B and cover A. Accordingly, the volume of said chamber varies, there being a pumping action from the interior of the canister to the atmosphere at the exterior thereof. At each reciprocation of the piston rod 27 there is a withdrawal of air from the canister while the rim 13 sucks into sealed engagement with the seal of diaphragm B, and with each stroke the differential pressure is increased, with positive pressure held at the exterior. As shown, the valves V1 and V2 are check valves adapted to govern one-way flow from the canister interior through the diaphragm pump chamber and to atmosphere. In FIGS. 7 and 13 the valve V1 is a strap valve that seats flat against the inside face of the position plate 25–26. In practice, there is a port 63 opening through the piston and plate, with fastener openings 64 diametrically related to and equally spaced therefrom to receive anchors 65 projecting from the flat strap 66 that comprises the valve element.

The valve V1 is critical to operation of this vacuum pack container, in that it is imperative that a leakproof closure be established so as to prevent the entry of atmospheric pressure into the container. Even a slight leakage cannot be tolerated. Accordingly, the strap 66 is substantially wider than the port 63 and is made of an elastic of soft supple rubber material or the like that is flexible and conformable to the piston plate face surrounding the port. There is an embossement 67 carried by the strap and overlying the port 63, to be held down through engagement with the overlying cover A and in order to prevent blow-through or extruding of the strap through the port when under external pressure. The anchors 65 are enlarged tits that are frictionally engaged in the openings 64 to secure the elastic strap 66 against the piston plate, to be held thereagainst by means of pressure applied externally, and to lift when pressure is applied internally.

The valve V2 involves an O-ring 60 seated in port 63 upon which a ball valve element 61 is engaged and drops by gravity and/or pressure through the dynamics of flow and/or differential pressure. The port 63 is enlarged to receive a cage 62 cemented in position as shown, for restricted movement of the ball element 61 captured in working position by the O-ring 60 that is snapped into a retaining groove, valve V2 being open to atmosphere through an offset port 63' in the cage 62 seated in the top of the cover A.

The valve V3 is a relief or bleed valve (see FIG. 8), a poppet-type valve carried in a tube extending from beneath the piston 25 to atmosphere. As shown, the bleed tube 70 extends upwardly from the piston and plate 25–26 with a passage 71 therethrough opening at the underside of said piston 25. There is an opening 69 in the cover A to slideably pass the bleed tube 70, the axis of the tube being spaced from and parallel to the central axis and piston rod 27. The bleed tube 70 extends well above the cover A when the diaphragm is distended as shown in FIG. 1. The fit of bleed tube 70 through opening 69 is close and/or sealed with a gland 73 to retard and/or stop leakage. The bleed tube moves with the diaphragm and flow through the passage 71 is controlled by a check valve member in the form of a poppet 77 having a stem 78 extending from said passage to carry a manually engageable button 79 that is normally lifted by a compression spring seated in the tube. The valve V3 involves a downwardly faced O-ring 76 forming a seat upon which the poppet member 77 is upwardly engaged, and disengaged by depressing said button 79. The bleed tube 70 provides for restricted movement of the poppet element 77 captured in working position, the valve V3 bieng normally shut by spring pressure and alternately held open by manual depression on button 79 exposed therefor.

A short version of valve V3 is installed at one corner of the canister cover A' shown in FIG. 9 and as sectioned in FIG. 10. In this application bleeding of pressure to atmosphere is directly through the cover A' and independent of the pumping apparatus above described. Therefore, the tube 70 is short and there is no sliding engagement through a seal 73.

The valve V4 is a relief or bleed valve, a screw-type valve threaded onto a tube extending from beneath the piston 25 to atmosphere. As shown, the bleed tube 70' extends upwardly from the piston and plate 25–26, with a passage 71' therethrough opening at the underside of said piston 25. There is an opening 72' in the cover A to slideably pass the bleed tube 70', the axis of the tube being parallel with the central axis and piston rod 27. The bleed tube 70' extends well above the cover A when the diaphragm is distended as shown in FIG. 1. The fit of bleed tube 70' through the cover A is close and/or sealed with a gland to retard or stop leakage. The bleed tube moves with the diaphragm and is normally closed by a knurled cap 74 held to the bleed tube by a loose (leaking) thread 75 that captures a seal 76. When the cap is loosened, atmospheric pressure is permitted to by-pass the threads and enter beneath the diaphragm B when it is desired to break the vacuum and remove the closure.

The valve V5 as shown in FIG. 14 is a modified form of relief valve or bleed valve, preferably a screw-type valve threaded into the wall of the canister body 10, and comprised of a manually turnable head 80 with a shaft 81 threadedly engaged in the wall. The shaft is centrally ported into the canister and laterally ported beneath the head, which normally sets against a seal or gasket 83. Loosening of the valve V4 permits the external atmospheric pressure to enter the canister when it is desired to break the vacuum and remove the closure.

From the foregoing it will be seen that this Vacuum Pump Closure seals with the bead of an opened can or rim of a canister or any like container, and is operable through multiple operations to draw a very effective partial vacuum upon the interior of the chamber closed thereby and any content therein. In practice, the seals S1 and S2 are jambed onto the rim 13 of continuous smooth coplanar form, in the case of seal S1 to seal with both the rim 13 top surface and the inner diameter wall 14 of the container, and in the case of seal S2 to seal with the rim 13 top surface. The surrounding atmosphere pressures the bellows into tight hermetic engagement that maintains the pressure differential established thereby, to be broken only by a bleeding of the vacuum with valve V3, V4 or V5 that normalizes the interior and exterior pressures. Accordingly, the vacuum tends to draw moisture from the contained content and thereby prolongs its freshness.

Having described only a typical preferred form and application of my invention, I do not wish to be limited or restricted to the specific details herein set forth, but wish to reserve to myself and modifications or variations that may appear to those skilled in the art as set forth within the limits of the following claims:

I claim:

1. A removable vacuum pump closure for the open perimeter end of a container with content therein and including, a moveable diaphragm with seal means releasably engageable with the perimeter end of the container, a cover overlying the diaphragm and attached at its perimeter thereto forming a pump chamber therebetween, inlet check valve means opening upwardly through the diaphragm, outlet check valve means opening upwardly through the cover, and actuating means comprising a piston rod extending through the pump chamber and cover for operation at the exterior to reciprocate the diaphragm relative to the cover whereby a partial vacuum is increasingly drawn upon said container and content therein.

2. The vacuum pump closure for the open end container as set forth in claim 1, wherein the diaphragm is depressible and shaped over a rim of the container and held thereto by the increasing vacuum.

3. The vacuum pump closure for the open end container as set forth in claim 1, wherein the cover comprises a rigid plate sealed at its perimeter to the attached diaphragm.

4. The vacuum pump closure for the open end container as set forth in claim 1, wherein at least one of the check valves comprises a valve element seated upon a seal within a cage limiting movement of the valve element within operative confines.

5. The vacuum pump closure for the open end container as set forth in claim 1, wherein at least one of the check valves comprises a flexible strap valve element seated upon a face of the diaphragm.

6. The vacuum pump closure for the open end container as set forth in claim 1, wherein one of said check valves comprises a ball element seated on a seal within operative confines at the cover, and wherein the other one of said check valves comprises a flexible strap valve element seated upon a base of the diaphragm to seal thereupon within the operative confines of the pump chamber.

7. The vacuum pump closure for the open end container as set forth in claim 1, wherein the check valve opening upwardly through the diaphragm comprises a strap of elastic extending over a port through the diaphragm and anchored at its ends diametrically of the port.

8. The vacuum pump closure for the open end container as set forth in claim 1, wherein the check valve opening upwardly through the diaphragm comprises a strap of elastic extending over a port through the diaphragm and anchored at its diametrically opposite ends and by means of a pair of diametrically spaced tits projecting therefrom and into anchor holes in the diaphragm.

9. The vacuum pump closure for the open end container as set forth in claim 1, wherein the piston rod of the actuator means is operable by lever means at the exterior of the cover to reciprocate the diaphragm through a piston connected thereto within said pump chamber.

10. The vacuum pump closure for the open end container as set forth in claim 1, wherein the piston rod of the actuator means extends through a gland in the cover and is operable by lever operated cam means at the exterior of the cover to reciprocate the diaphragm through a piston connected thereto within said pump chamber.

11. The vacuum pump closure for the open end container as set forth in claim 1, wherein a relief valve means extends through the cover to be manually operable at the exterior thereof to release atmospheric pressure to enter the container.

12. The vacuum pump closure for the open end container as set forth in claim 1, wherein a relief valve means extends from the moveable diaphragm and through the cover to be manually operable at the exterior thereof to release atmospheric pressure to enter the container.

13. The vacuum pump closure for the open end container as set forth in claim 1, wherein a relief valve means extends through the cover and comprises a tube and a spring biased check valve element seated upwardly against a seal and depressible therefrom by a stem manually engagable at the exterior of the cover.

14. The vacuum pump closure for the open end container as set forth in claim 1, wherein a relief valve means extends from the moveable diaphragm and through the cover and comprises a tube and a check valve element seated upon a seal within a cage formed in the tube and limiting movement of the valve element adapted to be lifted from the seal by a stem extending therefrom and through the tube to the exterior for releasing atmospheric pressure to enter the container.

15. The vacuum pump closure for the open end container as set forth in claim 1, wherein a relief valve means extends from the moveable diaphragm and through the cover and comprises a tube and a manually operable cap normally sealed with the tube and held thereto by loose threads is adapted to release atmospheric pressure to enter the container when loosened.

16. The vacuum pump closure for the open end container as set forth in claim 1, wherein the seal is a depressible member surrounding the diaphragm and spaced therefrom and shaped to the perimeter end of the container.

17. A releasable vacuum pump closure for the open perimeter end of a canister with content therein and including, a moveable diaphragm with seal means releasably engageable with a rim of the canister, a cover overlying the diaphragm and attached at its perimeter thereto forming a pump chamber therebetween, check valve means opening upwardly through the diaphragm and cover respectively, actuating means to reciprocate the diaphragm relative to the cover whereby a partial vacuum is increasingly drawn upon said canister and content therein, and a normally closed relief valve means through a wall of the canister to release atmospheric pressure to enter therein.

18. The releasable vacuum pump closure for the open end canister as set forth in claim 17, wherein the diaphragm is depressible and shaped over a rim of the canister and held thereto by the increasing vacuum.

19. The releasable vacuum pump closure for the open end canister as set forth in claim 17, wherein the cover comprises a rigid plate sealed at its perimeter to the attached diaphragm.

20. The releasable vacuum pump closure for the open end canister as set forth in claim 17, wherein at least one of the check valves comprises a flexible valve element seated upon a face of the diaphragm.

21. The releasable vacuum pump closure for the open end canister as set forth in claim 17, wherein at least one of the check valves comprises a valve element seated upon a seal within a cage limiting movement of the valve element within operative confines.

22. The releasable vacuum pump closure for the open end canister as set forth in claim 17, wherein at least one of the check valves comprises a ball element seated on a seal within a cage limiting movement of the ball element within operative confines at the diaphragm and cover respectively.

23. The releasable vacuum pump closure for the open end canister as set forth in claim 17, wherein one of said check valves comprises a ball element seated on a seal within operative confines at the cover, and wherein the other one of said check valves comprises a flexible strap valve element seated upon a base of the diaphragm to seal thereupon within the operative confines of the pump chamber.

24. The releasable vacuum pump closure for the open end canister as set forth in claim 17, wherein the check valve opening upwardly through the diaphragm comprises a strap of elastic extending over a port through the diaphragm and anchored at its ends diametrically of the port.

25. The releasable vacuum pump closure for the open end canister as set forth in claim 17, wherein the check valve opening upwardly through the diaphragm comprises a strap of elastic extending over a port through the diaphragm and anchored at its diametrically opposite ends and by means of a pair of diametrically spaced tits projecting therefrom and into anchor holes in the diaphragm.

26. The releasable vacuum pump closure for the open end canister as set forth in claim 17, wherein the actuating means comprises a piston rod extending through the cover and operable at the exterior to reciprocate the diaphragm through a piston connected thereto within said pump chamber.

27. The releasable vacuum pump closure for the open end canister as set forth in claim 17, wherein the actuator means comprises a piston rod extending through the cover and operable by lever means at the exterior to reciprocate the diaphragm through a piston connected thereto within said pump chamber.

28. The releasable vacuum pump closure for the open end canister as set forth in claim 17, wherein the actuator means comprises a piston rod extending through a gland in the cover and operable by lever operated cam means at the exterior to reciprocate the diaphragm through a piston connected thereto within said pump chamber.

29. The releasable vacuum pump closure for the open end canister as set forth in claim 17, wherein the relief valve means comprises a manually rotatable screw accessible at the exterior of the canister wall and with a bleed opening and surrounding seal engaged with said wall when said screw is tightened.

30. The releasable vacuum pump closure for the open end canister as set forth in claim 17, wherein the seal is a depressible member surrounding the diaphragm and spaced therefrom and shaped to the perimeter end of the container.

* * * * *